US005945655A

United States Patent [19]

Gilgeous et al.

[11] Patent Number: 5,945,655

[45] Date of Patent: Aug. 31, 1999

[54] APPARATUS AND METHOD FOR COUNTING BINGO CARDS

[76] Inventors: Earle Gilgeous; Angela Walker, both of 705 Odell Avenue, Sarnia, Canada, N7V 2K6

[21] Appl. No.: 08/723,129

[22] Filed: Sep. 30, 1996

Related U.S. Application Data

[63] Continuation of application No. PCT/CA95/00533, Sep. 22, 1995, which is a continuation-in-part of application No. 08/336,122, Nov. 4, 1994, abandoned.

[30] Foreign Application Priority Data

Sep. 22, 1994 [CA] Canada ..... 2132666

[51] Int. Cl.[6] ..... G06K 7/10

[52] U.S. Cl. ..... 235/454; 235/456; 235/460

[58] Field of Search ..... 235/454, 375, 235/380, 456, 458, 460

[56] References Cited

U.S. PATENT DOCUMENTS

| | | | |
|---|---|---|---|
| 3,786,234 | 1/1974 | Trent et al. | 235/375 |
| 4,760,247 | 7/1988 | Keane et al. | 235/454 |

*Primary Examiner*—Donald Hajec
*Assistant Examiner*—Karl D. Frech
*Attorney, Agent, or Firm*—Ridout & Maybee

[57] ABSTRACT

The issue of bingo paper as controlled by producing packages of multiple sheets each including multiple bingo cards, with each card provided with a uniformly located machine readable index number, the index number of cards on a sheet, and on sheets within a package being related to each other and to a matrix of numbers appearing on each card such that the index number of each card uniquely identifies a number matrix appearing on that card, and that of other cards within the sheet, as well as the sheet and package to which it belongs, checking each package into inventory, machine reading the index numbers of sufficient of said cards as they are sold to identify which cards have been sold, and placing the said cards in play. Verification of cards is provided by machine reading the index number of a card claimed to be a winning card, verifying that it is a card in play, and identifying the number matrix carried by the card to verify that it is a winning card. Multiple cards can be identified at a time as they are sold by measuring the dimensions of a part sheet of cards to determine the numbers of cards therein and their positional relationship to a card at one corner of the part sheet, and matching reading the index number of the card at that corner to identify the cards transferred from stock to play. The index numbers are typically in the form of barcodes.

17 Claims, 5 Drawing Sheets

APPARATUS AND METHOD FOR COUNTING BINGO CARDS

REFERENCE TO RELATED APPLICATIONS

This application is a continuation of International Application PCT/CA95/00533 filed Sep. 22, 1995, which is a continuation-in-part of Application Ser. No. 08/336,122 filed Nov. 4, 1994, now abandoned.

FIELD OF THE INVENTION

This invention is concerned with the management of bingo cards. More particularly, it is concerned with the tracking of bingo cards handled at a bingo hall, to ensure accurate stock control and prevent fraud.

BACKGROUND OF THE INVENTION

Bingo is a well-established game of chance. The basic concept is that each player has a selection of numbers, randomly selected from a prescribed set of numbers, for example 1 to 75. The player's numbers are provided on a "card" or ticket, which has the selected numbers arranged in a 5×5 square, for example. The "cards" can be actual printed cards or tickets, or can otherwise be provided in various reusable forms, e.g. electronically. Then, from the numbers 1–75 or other set, numbers are randomly selected. This is commonly achieved by some device which has some visual appeal and reinforces the concept of the numbers are derived randomly. For example, the set of numbers are marked on a corresponding set of balls of equal size and weight which are agitated by a jet of air in a large transparent sphere. The balls are allowed to escape one at a time, from the sphere and their numbers are read off in sequence. Such a device is known as a "blower".

Depending upon the game being played, players are expected to complete, for example, a full, straight line of five numbers in any direction, two lines, four corners, the entire periphery of the card, the whole card, etc. Within one game, different prizes can be awarded for completion of different lines, the whole card, etc.

The game of bingo is played at many different levels. It can be played purely recreationally. It is commonly played for relatively small prize amounts, which may be in the form of small gifts. More recently, interest in the game has grown and more importantly, charities have discovered the game as an effective way of raising funds. These games are run on a large scale, involving many players in a large hall. The prizes are typically substantial cash sums.

In such games, to ensure the games are uniformly and fairly run, it is common practice to use disposable paper tickets or cards, which are pre-printed. It is also common practice for experienced players to play a number of cards simultaneously in any one game, e.g. in the order of a dozen cards.

Depending upon the nature of the game and the supplier, the bingo cards are typically provided in sheets or strips containing a number of individual cards. These are commonly referred to generically as bingo paper. The individual strips can have a variety of strip lengths and depths. For example, a strip may have a length equivalent to eight cards and be three cards deep, for a total of 24 cards. To speed up play in large halls, the cards are sold either at one or more central fixed or mobile locations, and also by floor sellers. A floor seller is an individual on the floor with a supply of cards, for sale to customers. The floor sellers could also double as checkers of winning entries.

Since many experienced players will play a number of cards at once, it is common for a player to purchase all or part of a complete strip. The cash paid by the customers forms a basic pool of money for each game, from which is deducted the prize money and appropriate operating expenses, to leave a profit for the organization, e.g. a charity, on whose behalf the same is run. It will be appreciated that it is extremely important to maintain accurate and complete control of the supply of the bingo cards, where there are significant cash prizes.

It will be apparent that for these larger, fund-raising bingo games, there is then the immediate problem of controlling large quantities of bingo cards. At a minimum, it is necessary to maintain a control on these, to ensure proper accounting of funds received and prizes dispensed. Also, in view of the large sums involved, there are many opportunities for fraud. Lax control of bingo paper can give rise to many opportunities for fraud. For example, it is not unknown for people to acquire bingo cards from unauthorized sources, by theft or otherwise, and then to use these unauthorized cards at a bingo game, without having purchased them for the appropriate face value in the usual way. Alternatively, they may sell such cards to others, depriving the operator of revenue.

This problem has been recognized by others and the applicant is aware of at least one proposal for a computerized gaming management system. This relies upon hardware including cash registers, a computer, printer etc., and software including encrypted coding for communication between the different elements of the system. It is intended to provide a complete track on the flow of the paper cards. These are logged into the system. As the cards are sold, they are logged out. This enables a variety of accounting calculations to be made, giving figures such as internal sales for a particular game, prizes awarded, profit etc.

However, a key weakness in this known system is that it relies essentially on some form of manual entry of the cards, both to log them and to log them out. Thus, when boxes of cards are received from a printer, the number of cards received is entered (it is not known by the applicant to what extent individual serial numbers may or may not be entered both when logging in and when logging out). As he individual cards are sold, either individually or as portions of complete strips, in the course of play, these are again recorded on the system. Again, this requires manual entry. In either case, it will be appreciated that manual entry gives the possibility of errors being made in the number of cards entered or received, and the number of cards sold. In particular, at a busy bingo session, it will be readily appreciated that a busy seller of the cards can easily make a mistake in the number of cards sold. In any event, it requires the person selling the cards to make a manual entry in each case, which is time consuming and slows down the rate at which cards can be dispensed and sold. Further complications and opportunities for error or fraud occur when games are played using dual currencies, as often occurs when bingo halls are located close to national borders.

SUMMARY OF THE INVENTION

Accordingly, it is desirable to provide a suitable technique to enable complete and accurate tracking of bingo paper, both with a view to eliminating human error and preventing fraudulent activities.

Ideally, any such system should uniquely identify each bingo card and enable it to be tracked from production at a printing facility until it is used in a bingo hall. Inputs into the system should, to the greatest extent possible, be automated, and serial and other identification numbers should preferably be automatically read or entered, to eliminate human error, and also the possibility of fraud.

The invention is described further below with reference to a preferred embodiment, and its scope is defined by the appended claims.

BRIEF DESCRIPTION OF THE DRAWING FIGURES

For better understanding of the present invention and to show more clearly how it may be carried into effect, reference will now be made, by way of example, to the accompanying drawings which show a preferred embodiment of the invention and in which.

DESCRIPTION OF PREFERRED EMBODIMENT

Figure 1:
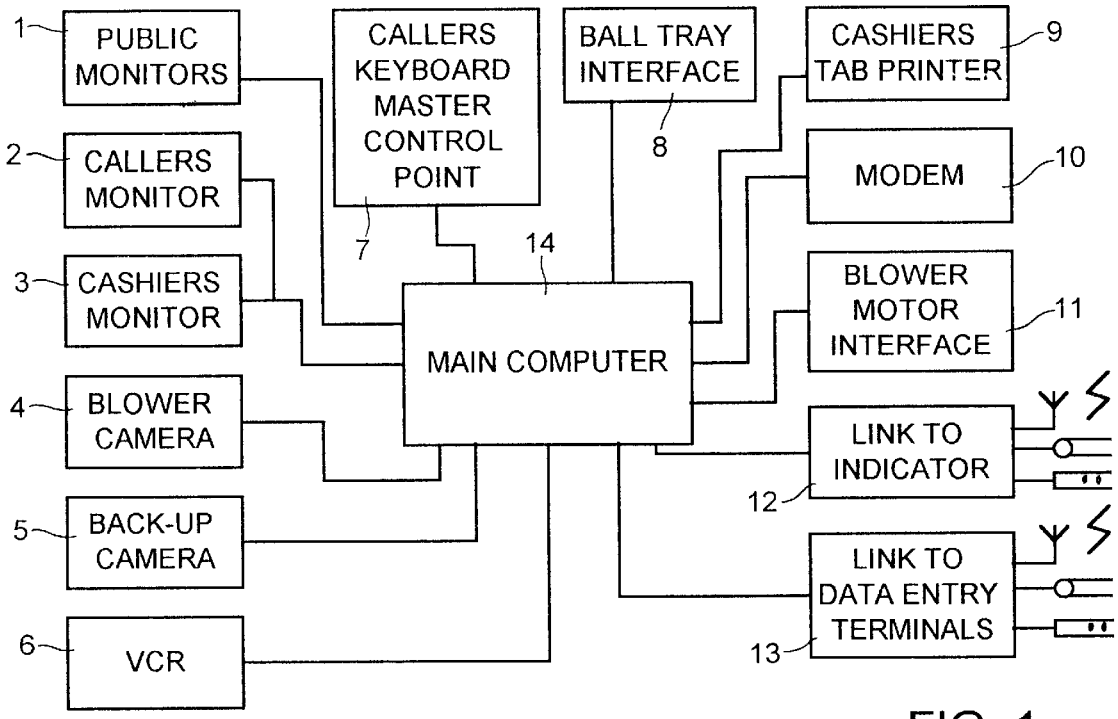
FIG. 1 is a schematic diagram of a computer system for managing bingo games and particularly bingo cards used therein.

Referring to FIG. 1, there are shown the principal components of a computer controlled system for managing a bingo hall, and particularly the bingo cards used therein. It includes the components described below.

Figure 2:
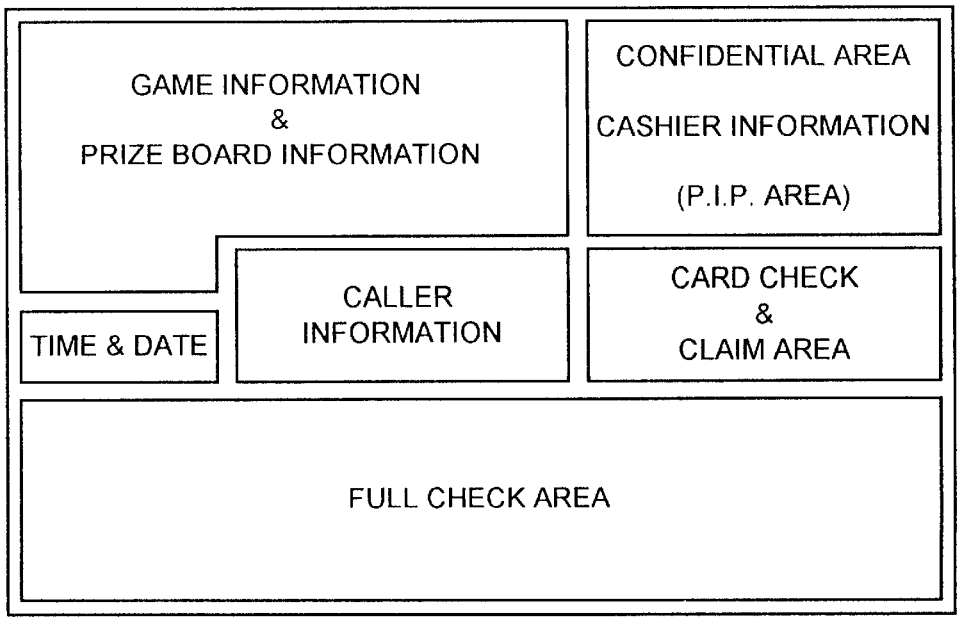
FIG. 2 illustrates the layout of a screen of the caller's monitor shown in FIG. 1.

Public television monitors 1 are provided mainly for the benefit of patrons so that they can see the current number being called on a blower camera 4. The public monitors are also used to show valid bingo claims by displaying a representation of the face of a winning bingo card after a win has been verified. The display is switched under control of a computer 14 from the blower camera 4 to the card representation as required. When the public monitors are not in use during the session for either of these purposes they may be used for promotional purposes, e.g. promoting forthcoming events at the hall or snack bar facilities by playing prerecorded material from a video cassette recorder (VCR) 6 under control of the computer 14. The VCR 6 is normally used to record the blower camera output for verification purposes. A caller's monitor 2 shows the caller all the information relevant to the control of the bingo game, neatly in an integrated display (see FIG. 27). This information includes a picture showing the number of the current ball (this is viewed in a picture in picture area, (PIP)). numbers already called, and relevant game information, e.g. for what prize the game is being played, etc. An example of a caller's screen layout is shown in FIG. 2.

The picture-in-picture area is provided utilizing conventional technology to generate position signals used gate a subpicture formed by stored digital samples of the b-y, r-y and y components of the blower camera output, into video data stored in video memory of the main computer at the position specified by the position signals, the combined digital data being passed to digital to analog converters and antialiasing filters to produce b-y, r-y and y signals which together with video synchronization signals permit a composite video signal to be provided which can be displayed on the caller's monitor, all using known video processing technology. A unique feature of the present system is the use of the picture-in-picture insert on the caller's monitor and other monitors carrying the same display to determine what data from the computer display will be visible, thus enabling sensitive or irrelevant information to be concealed from the caller or other users, while being available to the cashier or supervisory personnel in place of the ball image from the blower camera.

A cashier's monitor shows the cashier the financial status of the game, i.e. how many tickets have been sold and other relevant financial information. This information is located in the PIP area of the same screen that is displayed to the caller, except that the caller cannot see the financial information since the information provided to the cashier is replaced for the caller by picture-in-picture information showing the output from the blower camera. When a win has been claimed and then verified the cashier will receive on the PIP section of the screen the necessary information for each win or claim, according to how many claims are made and what the initial prize was for the win pattern of line claimed. The cashier will also receive information as to multiple valid claims or dual currency valid claims. On the caller's monitor this information is replaced by the blower camera output.

A backup camera 5 may be provided as a spare camera or for use in Bonanza style bingo games. It may be used in exactly the same way that the blower camera 4 is used.

A caller's keyboard master control point 7 at the caller's station is a master control point for the main computer 14. Although the system is normally used to control the playing of bingo, the system may perform other computing tasks and functions. Accordingly, it requires several levels of security to be implemented. For example a manager would have a greater security level than a caller, and a caller would have a higher security level than a cashier or runner. The caller's keyboard is used to input to the computer control and game information, for example data as to what win lines are to be played, prize values is and the colour of paper (cards) to be used in a particular game. Inventory is also confirmed from the caller's keyboard.

A ball tray interface 8 is connected to a ball tray which receives the numbered balls taken from the blower. Once a numbered bingo ball is placed in its location in the ball tray the interface signals the main computer that the number is called and a signal is sent to public display indicators through an interface 12. This information is also displayed on the caller's monitor, in the full check area, as shown in FIG. 2.

A cashier's tab printer provides pay-out information for the cashier, to enable preparation of cash pay-outs for patrons winning claims. The printer communicates serially with the computer 14, so that the main computer is not wholly tied up handling the printer while other functions are required, e.g. card checking or verification or continuation of a game.

A modem link 10 may be provided so that game or inventory information can be transmitted to a remote computer or a designated point, e.g. municipal offices, corporate headquarters, main administration offices, or to a paper suppliers' office with inventory figures to allow for more efficient stock management.

A blower motor interface 11 allows the caller to switch the blower on remotely or to switch it over to a back up blower.

The communication interface 12, which may be wired or wireless, is provided between the main computer and the indicator boards. The indicator boards are updated when a ball is placed in the ball tray interface thus telling the computer system the current number called. This information is then transmitted through the interface in a coded data packet form to the indicator boards and is there interpreted by their own internal circuitry, which decides on the type of coded data packet received and displays the relevant information on the relevant sections of the indicator board. This may involve such functions as flashing the current number called and then adjusting the ball count, which form no part of the present invention.

The nature of the communications interface 12 (wired or wireless) is dependent on the site conditions, and the preference and budget of the hall operator. A communications interface 13 is also provided between the main computer and terminals 15 and 40. This interface may utilize bi-directional wired or wireless communication (as schematically shown in FIG. 1) with point of sale terminals 40 (see FIGS. 3–6) and hand held terminals 15, sending data to the terminals and receiving information and control commands from either a keyboard or a barcode reader at the terminal. For portability reasons a wireless link at least to the hand held terminals is preferred.

The main computer 14 is of conventional configuration, comprising a main CPU, main and video memory, program and data mass storage means, a network manager and appropriate peripheral functions. The main CPU is responsible for the control of bingo games during a session, and provides storage for game information, such as programme/session details and prize money, in addition to providing card check or verifier resides. It is responsible for the network management of the communications network, and routes information to the indicator boards and the hand held terminals, as well as receiving data from the portable terminals 15 and point of sale (POS) terminals 40, described further below.

Figure 7:
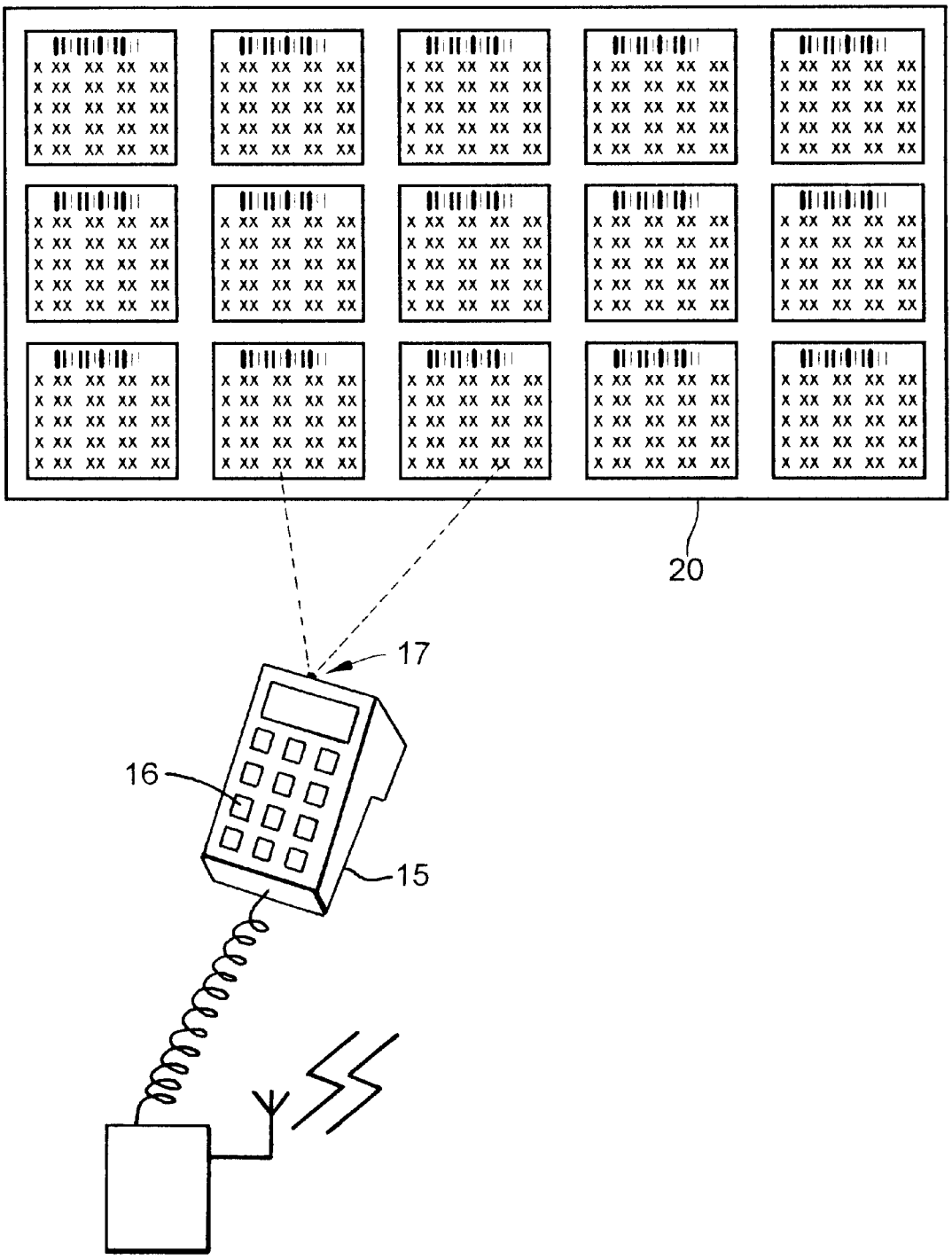
FIG. 7 is a schematic view of a hand held terminal utilized in the system.

The hand held terminals 15 (see FIG. 7) include both a keyboard 16 and a barcode reader 17 for data entry, and may perform numerous tasks and functions. In that they access the main computer, different functions may require passwords requiring different levels of security clearance to be entered by the user through the terminals. The terminals may firstly be used as additional point of sale terminals (POS) for the selling of cards or tickets at a cashiers counter or elsewhere. In this mode of operation they can also be configured to control a cash drawer if required.

A second function is to validate potential winning bingo claims achieved by reading a barcode on the patron's card. They can also be used to read barcodes on packages to provide input for bingo paper inventory. Deliveries from a bingo paper supplier are checked off at the hall by reading an unique bar code on the outside of each box of bingo paper using the bar code reader of a portable terminal, which then communicates with the main computer, via its network manager, to input the inventory information and record the bar coded data in an input inventory file from whence the data may be checked by a person with appropriate authorization against the supplier's delivery note, and transferred to a stockpile by a suitable computer entry. Such inventory functions need not be limited to bingo paper, but may be extended to snack bar merchandise and other items. As long as each item input has its own inventory barcode then it can be input into the system using a portable terminal.

The barcodes used in association with the bingo paper are utilized to enable management of the bingo games being played in the hall. Incoming packages of strips are identified as already indicated by a barcode, which adequately identifies each package and provides other information about the content of the package such as the color of the strips, the type, size and number of cards or tickets in each strip, and a product code. Within a package, the cards on each strip or sheet carry barcodes which identify at minimum the package from which they came, the matrix of numbers which each card carries, and the location of a card within the strip. It will be understood that the identity and location of the numbers and the position of the card within the strip may be represented indirectly by codes. For example, if card locations within a strip are regularly numbered, and sheets within a package are numbered, external data as to how the cards in the numbered sheets are printed may be utilized together with the sheet and card number to identify precisely the pattern of numbers and position on the sheet of any card within the package, although the codes preferably present at least some of this information directly. What is essential is that each card carries a machine readable code which uniquely identifies the card and the package from which it comes, and preferably also its position within a strip.

It should be understood that the data contained in the barcodes is preferably encrypted to avoid unauthorized interpretation other than by the central computer, and that the codes may include data relating to the encryption system utilized (which itself forms no part of the invention), and error detection and correction codes such as are commonly used to verify and ensure correct reading of digital data.

As already indicated, the package codes enable packages to be checked into stock as recognized by the central computer 14. As each card is sold prior to a game, its identity, as indicated by its barcode, is entered into the computer by barcode readers at the POS terminals 20 or portable terminals 15, and it is thus removed from stock and placed in play by the computer, which can check that the card comes from stock and is of the colour and type being used in the particular game for which cards are being sold, thus eliminating the principle known source of fraud and error in the acquisition of cards by patrons.

As indicated above, patrons frequently purchase multiple cards forming all or part of a sheet. In order to simplify and reduce the risk of errors or omissions in the card data in such multiple sales, and provided that the codes carried by the cards identify their position within the sheet, the apparatus to be described with reference to FIGS. 3–7 may advantageously be used.

Figure 3:
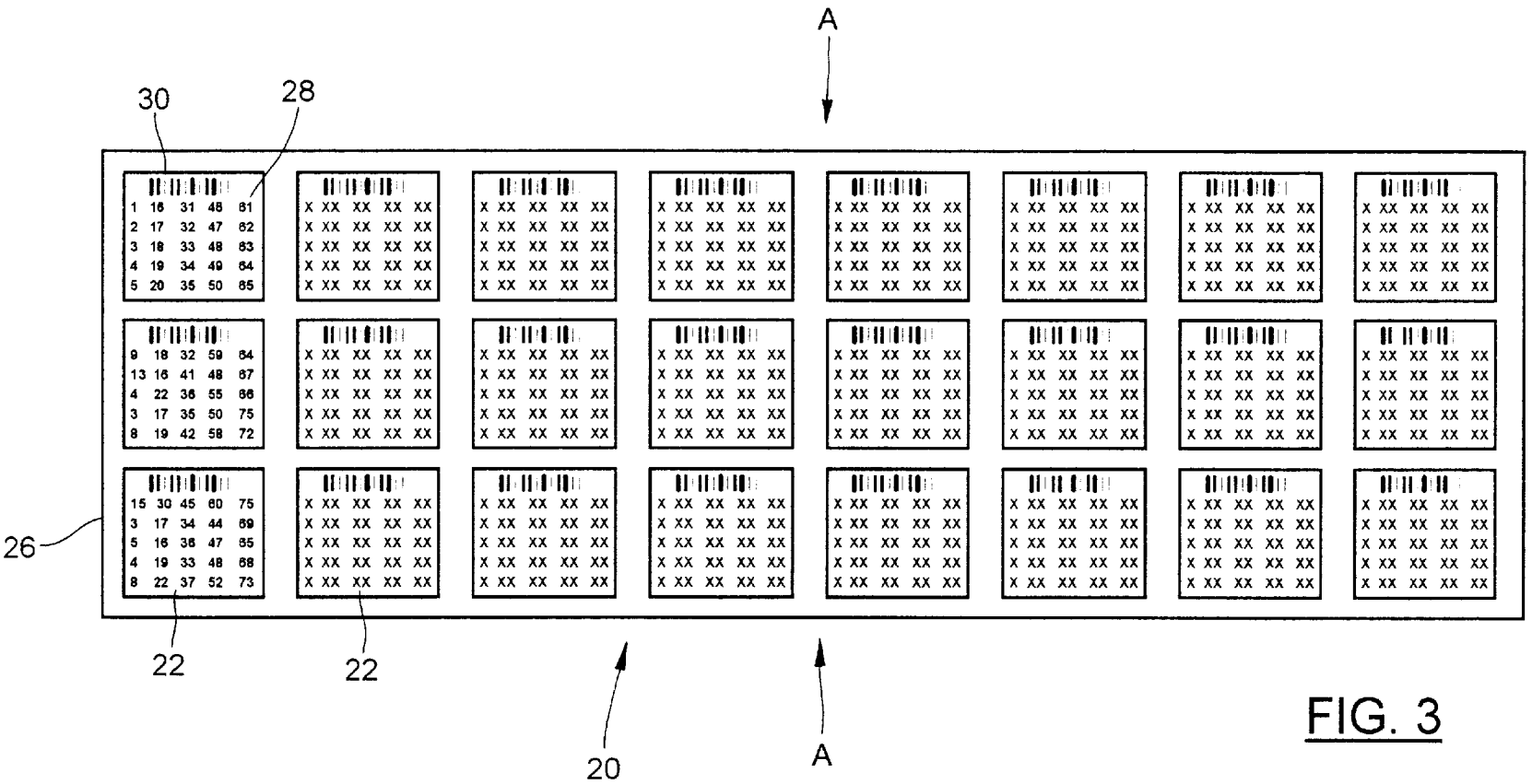
FIG. 3 is a plan view of an exemplary strip of bingo cards.

Referring first to FIG. 3, there is shown a strip 20 of bingo tickets or cards, with individual cards being indicated at 22. The strips 20 can have a variety of different configurations and typically individual manufacturers will have different standard arrangements for the cards, as well as different dimensions for individual cards.

The length of the strip is indicated at 24 and its depth at 26. Both the length and depth are determined by the number of cards in each direction. Thus, in this exemplary embodiment, the strip length is 8 and the card depth is 3.

In known manner, each card 22 has a playing area 28 in which there is a 5×5 matrix of numbers. Conventionally, the numbers are selected from the series 1–75 and distributed into 5 columns with numbers selected from 1–15 are in the first column, numbers selected from 16–30 in the second column, etc.

As already described a barcode 30 is provided for each card, located above the playing area 28. The barcode 30 is unique to each card and in the example shown includes a variety of information, including details of the manufacturer, a product code (preferably a Universal Product Code—UPC), colour of the sheet, a serial number unique to a package or series of strips or sheets, and an index number unique to each individual card. Each index number is unique to a card, and preferably consists of a unique set of numbers from the range 1–75 and having a specified relationship to the matrix of numbers printed on the card, so that from the index number alone, the number matrix carried by the whole card can be recreated for checking and other purposes.

Further, on any particular strip, the index numbers of the cards have a specified mathematical relationship. In effect, if one knows the index number of one card, its position in the strip, and the size of the strip, the associated index numbers for all other cards can be determined. Since any index number enables its corresponding card to be recreated, this in turn means that all the cards in a strip can be recreated from the index number of just one card.

Now, as noted above, a full sheet of 24 or more cards is too large for common usage. It is frequently cut into smaller sizes to give a more manageable number of cards. As indicated in FIG. 3, it can be cut into two strips indicated by the arrows A. Conventionally, if this is done it requires the distributor or seller of the cards to manually separate the cards and determine exactly how many have been sold. Further, it has conventionally not been practical to record exactly which index numbers have been sold.

Figure 4:
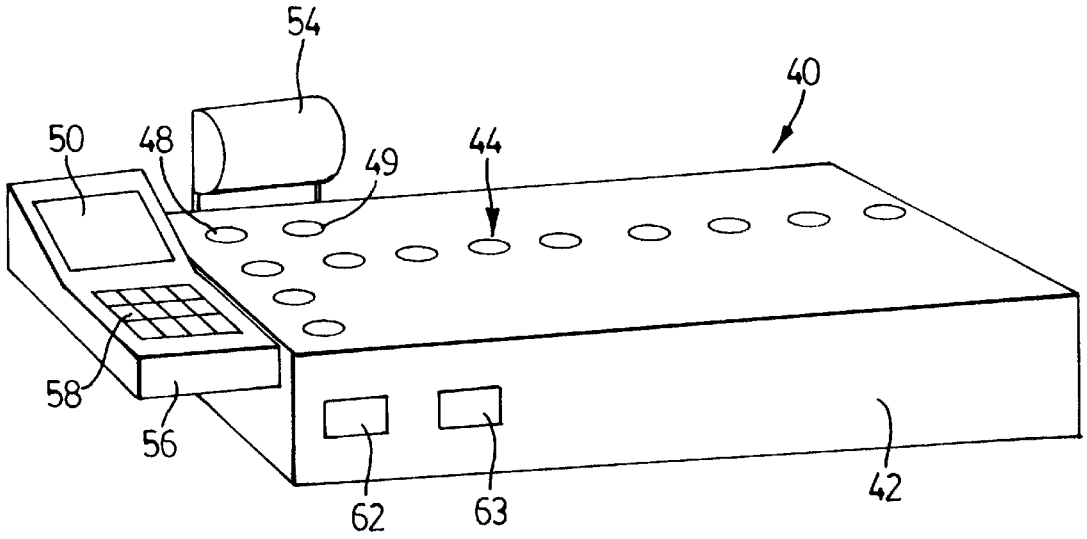
FIG. 4 is a perspective view of a point of sale terminal for selling cards.
Figure 5:
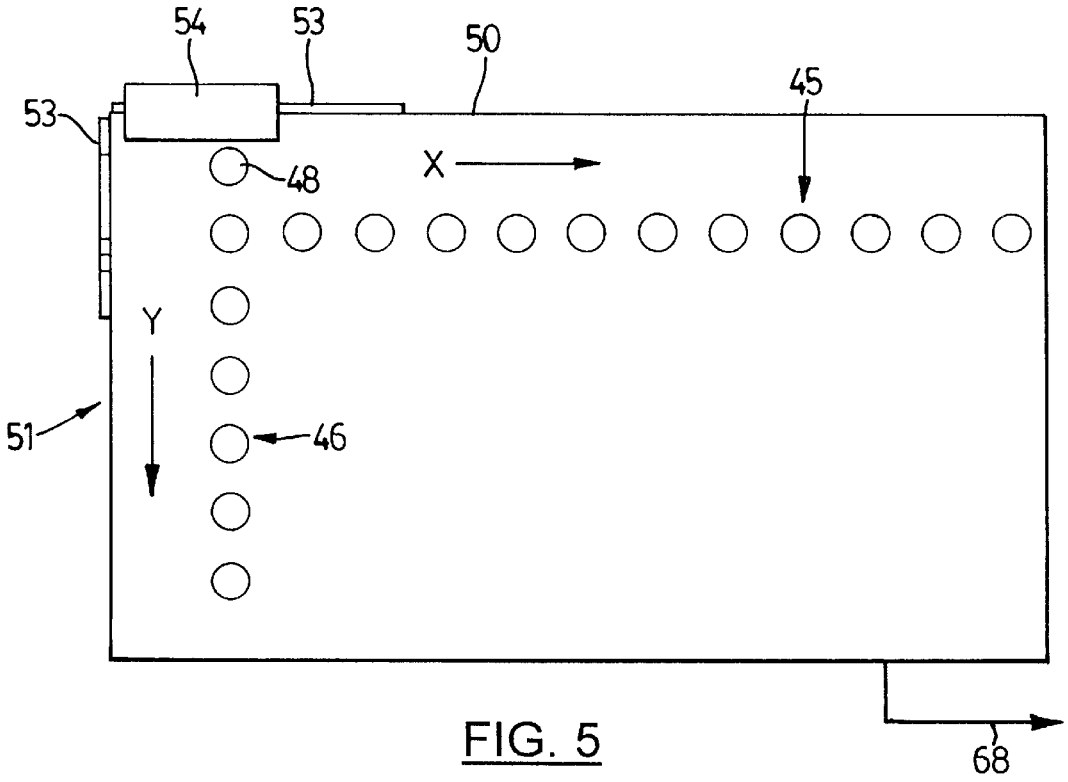
FIG. 5 is a plan view of the apparatus for FIG. 5.

The point of sale terminal 40 shown in FIG. 4 permits automatic determination of which cards have been sold. The terminal includes a base unit 42. A sensor array 44 on the base unit comprises, as best shown in FIG. 5, a first row 45 of first sensors extending in an X direction, and a second row 46 of second sensors extending in a Y direction. The first row 45 serves to determine the number of columns in the strip, i.e. the strip length, while the second row 46 determines the card depth or number of rows of cards.

An activation sensor 48 is provided at the top left hand corner of the base unit 42 presenting a platform to receive port sheets or strips of bingo paper. The activation sensor 48 serves to sense when a strip is in position for reading the size of the strip. A card type sensor 49 is also provided, which is used to determine whether or not a corner of the first card is missing. Thus providing a means to distinguish between classes of cards, one of which has a corner missing.

To facilitate location of a strip on a base unit 42, abutments 53 are located along the top side 50 and left hand side 52 of the base unit, so that in use a strip can be placed on top of the unit 42 and simply slid into the top left hand corner against these members. It will then activate the activation sensor 48. The apparatus or device can have a body formed from sheet steel or the like, and in this case, the abutments 53 can be a continuous strip running around the corner.

For reading the barcode 30 of the card a barcode reader 54 is provided in the top left hand corner of a strip. To the left of the base unit 42 the POS terminal includes a suitable key pad 58 and a Point of Sale (POS) display 50. Buttons or switches 62 and 63 are provided for confirming that barcode data should be read or indicating that it should not be read and entered.

One or more of the base units 42 may be provided. As indicated at 68 there is a connection to the interface 13 of main computer 14.

Figure 6:
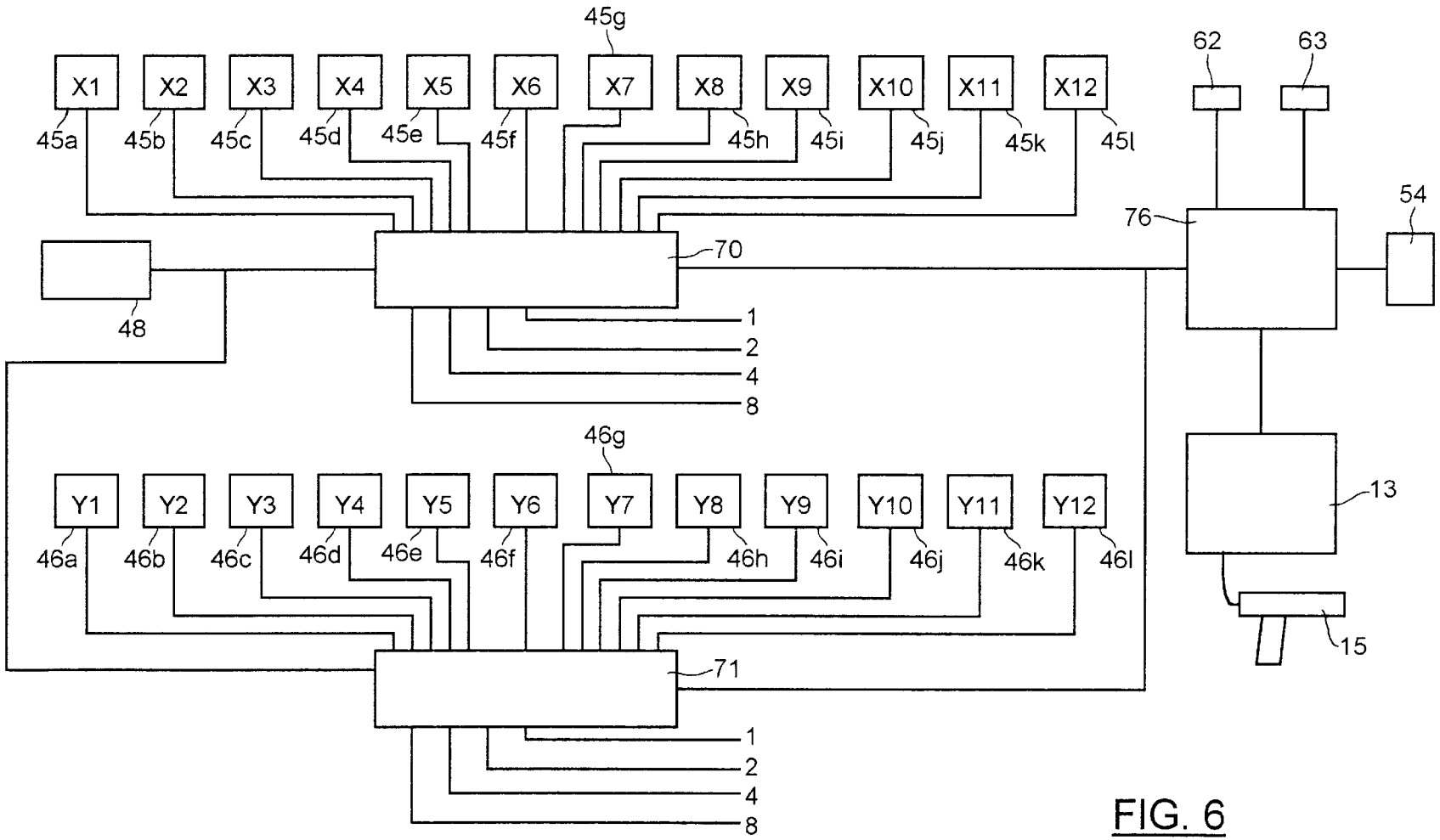
FIG. 6 is a schematic diagram of circuitry of the apparatus of FIGS. 4 and 5.

FIG. 6 shows connections to the sensor array 64. Two programmable logic devices 70 and 71 receive inputs from the sensor rows 45 and 46 for determining the strip dimensions in the X and Y directions respectively. The programmable logic devices are of type PLS153AN, but it will be appreciated that any suitable device can be used. The sensors in the rows 45 are denoted by the references 45*a*, 45*b*, etc., while the sensors in the rows 46 are denoted 46*a*, 46*b* etc. In the embodiment shown, twelve sensors are provided in each direction. The sensors 45*a*–45*l* are connected to inputs of the logic device 70, while the sensors 46*a*–46*l* are connected to the logic device 71. Each of the devices 70, 71 has four binary outputs, representative of the numbers 1, 2, 4 and 8 in known manner. The activation sensor 48 which senses when a card or strip is in place is connected to the programmable logic devices 70 and 71, and activates them once the presence of a strip is sensed. It would also be possible to provide a matrix of sensors rather than just two rows, so that non-rectangular part strips can be detected.

The logic device 70 will then determine which of is sensors 45*a*–45*l* have been activated to indicate the presence of a sheet. For example, if a strip with a length of 6 was placed on the base unit 42, sensors 45*a*–45*f* would be activated, with the sensors 35*g*–35*l* inactive. The device 70 would recognize these 6 inputs and make its outputs for the numbers 2 and 4 active,i.e. for binary output of 110 corresponding to the number 6 in decimal notation.

Similarly, the logic device 71 will determine which of its sensors 46*a*–46*l* have been activated. If for example, the sheet has a depth in the Y direction of 3 cards, then sensors 46*a, b* and *c* will be active, which in turn results in the outputs 1 and 2 of the device 71 being active. These outputs are connected to a parallel port of a microcontroller 76, which is also connected to the switches or buttons 62 and 63, to the central computer 14 and to the barcode reader 54. As indicated, hand held bar terminals 15 may also be connected to the computer 68.

The microcontroller 76 interrogates the logic devices 70 and 71. If the error or cancel button 52 is pressed, then no data is read, while if the enter button 53 is pressed, then data is read from the devices 70 and 71. It is therefore possible for the microcontroller 74 to calculate the size of the strip and determine its dimensions in both the X and Y directions. If the pitch of the detectors is the same as the card pitch, the number of cards is the numbers of sensors covered in the row 45 multiplied by the number of sensors covered in the row 46, or if a sensor matrix is used, the number of sensors covered represents the number of cards. If the sensor pitch is less than the card pitch, additional factors based on card dimensions must be applied.

The microcontroller then activates the barcode reader 44 to read the barcode of the card at the top left hand corner. From the information contained within this bar code, and knowing the size of the strip, the index numbers and individual numbers of each individual card can be determined. As a practical matter, this information need not immediately be retrieved or recreated. Rather, the bar code of the card at the top left hand corner is recorded. If it is necessary to retrieve an individual card for checking purposes, then this is achieved by dis-encrypting the serial number for the desired card from the top left hand corner card, and then determining the full layout for that card, using either an algorithm defining the relationship of the matrix numbers and number matrices on the cards, or a look-up table stored by the computer 14 and providing equivalent information for the type of card being handled. In other words, the index numbers and layouts of individual card or cards for the full strip need be recreated from that index number only as required, for example to verify a winning card. The appropriate card can then be reconstructed and checked, and more particularly it is possible to create and display a representation of the number matrix on the card for display on the public monitors 1, so that other patrons may see that it is indeed a winning card.

A variety of different sensors can be used both for the sensor rows 44 and 45 and for the activation sensor 48. Each sensor could be a photo detector, a simple mechanical switch operated by a feeler, or any other device capable of sensing the presence or absence of a card above it. The exact choice of sensor will depend upon factors such as desired cost, durability etc.

The photodetector or optical sensor is preferred. Such a sensor relies on the reflective qualities of the paper stock. As such it can detect paper even if it is not entirely flat. Also, it can be set up to distinguish between paper and other surfaces such as an operator's hand, which may accidentally or deliberately obscure a sensor.

Where photodetectors are used, the representations in the drawings would be openings in the top surface of the device. These could be covered by transparent windows with the detectors beneath.

The arrangement of the sensors will depend upon the strip sizes to be read or measured. If uniform strips from one manufacturer only or strips all having similar configurations and similar card sized are used, then a relatively small number of sensors can be used. In such a case, one sensor for each card in length or depth will suffice. The description above assumes that this is the case. On the other hand, bingo halls routinely receive strips or cards from a variety of printers, for purposes of playing different games. As a result the strips and card sizes can vary greatly. To accommodate this, a relatively large number of sensors can be provided, as indicated in FIG. 5. In such a case, each increment in length or depth of a strip will commonly activate two or more sensors, depending upon the exact size of each card. In such a case, information from the barcode will effectively identify the supplier and hence the size of each card. The information as well as the sensors activated can be combined by a microprocessor to determine the effective strip size and the number of cards present.

While individual strips of cards can be read by the barcode reader 54, it can also be used to determine when a series of strips has been dispensed. For example, as received from a printer, the strips are usually bound or glued together along their upper edges in set quantities, for example 25 strips. These would be numbered sequentially.

A complete book of 25 strips can be given to a floor seller. Beforehand, the serial number from the top left hand corner of the top strip is read. Before the start of the next game, the floor seller returns any unsold strips and the card in the top left hand corner of the uppermost remaining strip is read. One can then determine which strips have been sold. For example, the computer can determine that the top sixteen strips have been sold and the other nine remain unsold. Due to the known relationship between the various serial numbers, all the strips and cards sold can be determined and decompressed as desired. Alternatively, if the floor seller is provided with a portable terminal 15, the index number of each card can be entered as it is sold, with a procedure as provided above possibly being used to check that unsold cards have been returned.

When individual sales are made to customers, a similar technique to that outlined above is used to determine which cards have been sold. In other words, the first and last serial numbers are read and the intervening serial numbers, for a series of strips, are determined from a known relationship.

A common practice, at least in Canadian towns and cities which are close to the U.S.—Canadian border, is to permit patrons to play in different currencies. For example, they can select to play in either U.S. or Canadian dollars. To keep track of this, where a bingo card is sold in one of the two currencies, for example U.S. dollars, the top right hand corner of the card is cut off. When such a card is placed on the platform of terminal 40, the card type sensor at 49 remains uncovered and hence inactivated, to provide an indication that this card is being played in U.S. currency. Where a complete strip or a number of cards being sold, it is a simple matter to cut off the top right hand corner of the card in the top left hand corner, even if it remains attached immediately to the right, with the cards being sold together.

When stock is received from a printer, barcodes are read usually from the outside of the box by a hand held terminal 15. This enables records to be kept of the serial numbers received from the printer so that cards fraudulently introduced into a bingo hall can be detected. It ensures that only cards read into stock can be read out again and into play as each sale is made, the hand held terminals also being used to read in the index numbers of cards for which a win is claimed both to verify that the card is one sold for that game, and to reconstruct the number matrix on the card so that the claimed win may be verified.

The software utilized in the system has not been described in detail since in general it is quite similar to that utilized in combination point-of-sale and inventory systems utilized in stores. It differs however in that, rather than each item within a package placed in inventory being identical, each card within a package is instead unique, and must be individually identified both as it is sold and placed in play, and in the event that a claim is made by the purchaser. The additional programming required to implement the system is believed however well within the ability of a programmer ordinarily skilled in the implementation of point-of-sale systems and provided with this specification. Likewise, any encryption scheme utilized may be conventional. While various algorithms may be utilized to generate number matrixes for cards on a sheet and successive sheets in a package so that the index number of a single card may be used to recreate the number matrix not only of that card but other cards on the sheet, look-up tables stored in the computer 14 may be used to provide the same function provided that cards in each package are indexed and provided with matrixes on a consistent basis, which is in practice desirable to facilitate printing of the bingo paper, during which the matrixes must be generated in a consistent manner.

While barcodes located at a particular position on the cards have been disclosed, other machine readable indicia located at a consistent position on the cards could be utilized with the barcode readers disclosed being replaced by readers employing technology appropriate to the type of indicia used. Similar indicia would be used on the packages.

We claim:

1. A system for issuing bingo paper, comprising packages of multiple sheets each including multiple bingo cards, each package being uniquely identified by a code, and each card within each package being preprinted with a uniformly located machine readable code, the codes of cards on a sheet, and on each sheet within a package being related to each other and to a matrix of numbers appearing on each card such that the code of each card uniquely identifies not only a number matrix appearing on that card, but also the number matrix of each other card within the sheet, as well as the sheet in the package to which it belongs, means for checking each package into inventory, an apparatus for machine reading the codes of sufficient of said cards as they are sold to identify which cards have been sold and designate the sold cards as being in play, the apparatus further including means to reconstruct from the code of a card the number matrix of that card, the number matrix of any other card on that sheet, the code of the package from which it came, and the sheet within that package from which it came.

2. A system for issuing bingo paper, comprising packages of multiple sheets each including multiple bingo cards, with each card provided with a uniformly located machine readable index number, the index numbers of cards on the sheet, and on sheets within the package being related to each other and to a matrix of numbers appearing on each card such that the index number of each card uniquely identifies a number matrix appearing on that card, and that of other cards within the sheet, as well as the sheet and package to which it belongs, means for checking each package into inventory, an apparatus for machine reading the index numbers of sufficient of said cards as they are sold to identify which cards have been sold and designate the sold cards as being in play, wherein the machine reading apparatus comprises a base unit having a surface for receiving a sheet of bingo cards;

a first row of first sensors mounted on the surface and extending in one direction, with each first sensor being activated by the presence of a bingo card;

and first circuit means connected to the first sensors for determining the dimension of the sheet in the one direction from the number of activated first sensors.

3. A system according to claim 2, wherein the apparatus further includes a second row of second sensors mounted in said surface and extending in a second direction, for determining a second dimension of the sheet of bingo cards, each second sensor being activated by the presence of a bingo card; and second circuit means connected to the second sensors for determining the dimension of the sheet in the second direction from the number of activated second sensors.

4. A system according to claim 3, wherein the index numbers are barcodes and the apparatus includes a barcode reader located adjacent to the corner of the surface for reading the barcode of a bingo card located at the corner of the bingo card sheet.

5. A system according to claim 4, including a computer programmed to record the index numbers of cards placed in play and to receive numbers drawn during a game, and means to read the index number of a card claimed to be a winning and transmit the number to the computer, the computer being further programmed to check that the card with that index number is in play, and to identify the number matrix carried by that card and verify that it is a winning card by reference to the numbers drawn during the game.

6. A system according to claim 5, further including monitors having screens for displaying data from the computer relating to a game in progress, the data including confidential data and non-confidential data display in different area of the monitor screens, the data sent by the computer to certain monitors including alternative game-related picture-in-picture data inserted in the area reserved for confidential information.

7. Point of sale apparatus for issuing rectangular cards or tickets, each of uniform dimensions, both singly and in rectangular groupings of multiple cards or tickets, the apparatus comprising a base unit having a surface large enough to receive and align a largest grouping of cards to be issued with a corner card of the grouping in a predetermined position over a corner of the surface, an array of multiple sensors extending across said surface relative to said predetermined position, the dimensions of the array being determined by the largest grouping to be accommodated, each sensor in the array being operative to provide different output signals according to presence or absence of a card adjacent thereto, and a logic circuit receiving the output signals from said sensors and providing an output indicative of the dimensions of an area of the surface covered by cards or tickets, and hence of the number of cards grouped on the surface.

8. Apparatus according to claim 7, wherein the sensors are arranged in two perpendicular rows, the sensors in each row being arranged at a pitch equal to that dimension of a card or ticket extending parallel to that row.

9. Apparatus according to claim 8, for use with cards or tickets of different sizes wherein the sensors in each row are arranged at a pitch such that all sizes of cards will have portions adjacent at least two sensors in each row.

10. Apparatus according to claim 7, further including a barcode reader located to read a barcode on a corner card located adjacent said predetermined position.

11. Apparatus according to claim 7, further including a point-of-sale terminal receiving the output from said logic circuit.

12. Apparatus according to claim 7 including a further sensor located adjacent said predetermined position to provide a signal denoting the presence on the surface of at lest a corner card adjacent said predetermined position.

13. Apparatus according to claim 12, wherein the logic circuit must receive said presence denoting signal to provide an output.

14. A system for issuing rectangular cards or tickets printed in rectangular sheets or strips consisting of multiple cards, comprising: a stock of such sheets or strips; a support presenting a surface for receiving cards in an array forming at least a rectangular part of one of said sheets or strips, with a corner of the array in a predetermined position; an array of sensors associated with the support, for sensing cards adjacent thereto, such that a least one sensor of said sensor array is provided in a lengthwise direction for each card length increment of one of said sheets or strips, and in a widthwise direction for each card width increment of one of said sheets or strips or strips, the sensors each providing outputs indicative of a card adjacent thereto; and a logic circuit receiving the outputs of the sensors and in turn providing an output indicative of the dimensions of a card array.

15. A system according to claim 14, further including a barcode reader located to read barcode on one card of an array received on said support with a corner in said predetermined position, and wherein each card carries a barcode uniquely identifying that card, the sheet to which it belongs and its position in the sheet, such that the identity of other cards on the surface can be determined by reading the code of that one card and the dimensions of a card array in which it is comprised.

16. A system according to claim 15, further including a computer for storing data from barcodes read from cards and data as to the dimensions of card arrays from which the barcodes are read.

17. A system according to claim 14, wherein the cards or tickets are bingo cards.

* * * * *